US006458000B2

(12) United States Patent
Shappell

(10) Patent No.: US 6,458,000 B2
(45) Date of Patent: Oct. 1, 2002

(54) POWER CONNECTOR GROUND POLARIZATION INSERT AND CONNECTOR USED THEREWITH

(75) Inventor: David John Shappell, Hudson, FL (US)

(73) Assignee: Thomas & Betts International, Inc., Sparks, NV (US)

( * ) Notice: Subject to any disclaimer, the term of this patent is extended or adjusted under 35 U.S.C. 154(b) by 0 days.

(21) Appl. No.: 09/745,375

(22) Filed: Dec. 22, 2000

Related U.S. Application Data

(60) Provisional application No. 60/173,647, filed on Dec. 30, 1999.

(51) Int. Cl.[7] ..... H01R 13/64

(52) U.S. Cl. ..... 439/677; 439/681

(58) Field of Search ..... 439/677, 680, 439/685, 686, 681, 170, 171, 172, 173, 518, 956, 957

(56) References Cited

U.S. PATENT DOCUMENTS 2,535,356 A * 12/1950 Gilbert ..... 439/686
2,944,243 A * 7/1960 Schmier ..... 439/685
3,023,394 A * 2/1962 Hubbell ..... 439/357
4,081,779 A * 3/1978 Ranzanigo ..... 337/198
4,159,862 A * 7/1979 Funck et al. ..... 439/681
4,911,649 A * 3/1990 Helmich, Jr. ..... 439/170
5,577,923 A * 11/1996 Lee ..... 439/170
5,919,060 A * 7/1999 Lee ..... 439/518
6,102,724 A 8/2000 Ring ..... 439/320

* cited by examiner

*Primary Examiner*—Tulsidas Patel
(74) *Attorney, Agent, or Firm*—Hoffmann & Baron, LLP

(57) ABSTRACT

The present invention provides a removable, "snap-in" ground polarization insert for a power connector that accommodates insertion of a corresponding ground polarization pin therein. The insert is molded from the same insulative material as the surrounding housing. The insert remains separate from the connector until assembly of the final product, enabling the user to determine the requisite combination of a proper insert configuration and a corresponding plug or receptacle that is currently available in the inventory. The ability to delay assembly of the connector and insert thereby allows use of the connector with pre-existing plugs and receptacles in view of available inventory and current customer demands.

4 Claims, 3 Drawing Sheets

POWER CONNECTOR GROUND POLARIZATION INSERT AND CONNECTOR USED THEREWITH

This application claims priority to U.S. Provisional Application No. 60/173,647 filed on Dec. 30, 1999.

FIELD OF THE INVENTION

The present invention is directed to a removable ground polarization insert for a power connector. In particular, the present invention is directed to a snap-in ground polarization insert capable of having multiple configurations to accommodate engagement with a variety of pre-existing plugs and receptacles and reduce excess inventory thereby.

BACKGROUND OF THE INVENTION

It is often necessary and desirable to use power connectors, plugs and receptacles in a variety of indoor and outdoor applications. Typically, the plugs and receptacles include different mating pins and socket contacts, respectively, for uniquely mating a plug to its proper receptacle. While the plug contacts extend outwardly of the plug connector, the receptacle contacts are housed within the receptacle connector having the open ends flush with the face thereof. Consequently, the face of the receptacle must be uniquely manufactured to support and indicate the different receptacle contacts.

In conventional power connector and plug combinations it is therefore necessary to have a different female connector for each different ground pin. This requires manufacture of the contacts to maintain a high inventory level to meet customer demand for different combinations of plugs and receptacles.

It is therefore desirable to utilize highly reusable and directly interchangeable self-locking plugs, connectors and receptacles. It is further desirable to provide such components as being adaptable to a variety of pre-existing components so as to become universally applicable for a plurality of industrial applications.

SUMMARY OF THE INVENTION

It is an advantage of the present invention to provide a ground polarization insert for a standard power connector.

It is another advantage of the present invention to provide a ground polarization insert that ensures proper engagement of the insert with conforming plug pins so as relate to corresponding voltage ratings.

It is yet another advantage of the present invention to provide a ground polarization insert that accommodates plugs of varying configurations depending upon the state of pre-existing inventory.

It is an even further advantage of the present invention to provide a ground polarization insert which mates with existing plugs and connectors and also locks to existing standard receptacles.

In the efficient attainment of these and other advantages, the present invention provides a removable, "snap-in" ground polarization insert for a power connector that accommodates insertion of a corresponding ground polarization pin therein. The insert is molded from the same insulative material as the surrounding housing. The insert remains separate from the connector until assembly of the final product, enabling the user to determine the requisite combination of a proper insert configuration and a conforming plug that is currently available in the inventory. The ability to delay assembly of the connector and insert thereby allows use of the connector with pre-existing plugs and receptacles that might otherwise be incompatible in view of available inventory and prevailing customer demands.

Figure 1:
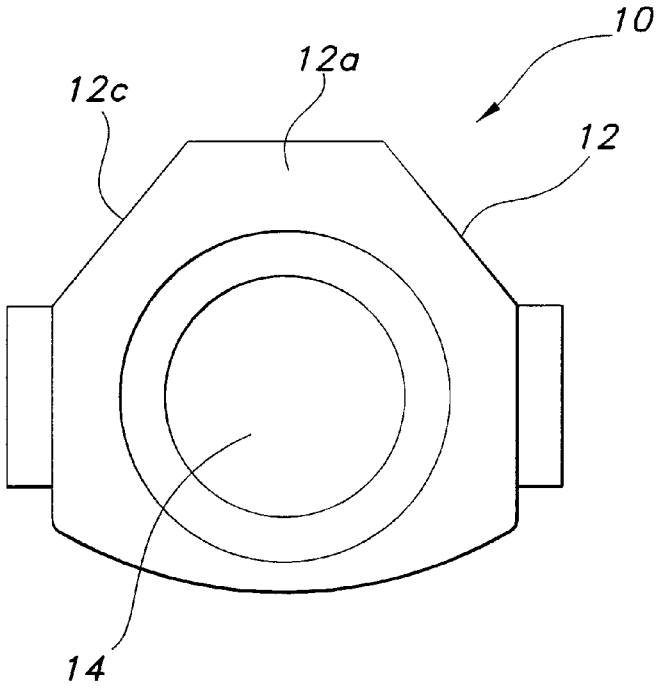
FIG. 1 shows a front view of a ground polarization insert of the present invention.
Figure 2:
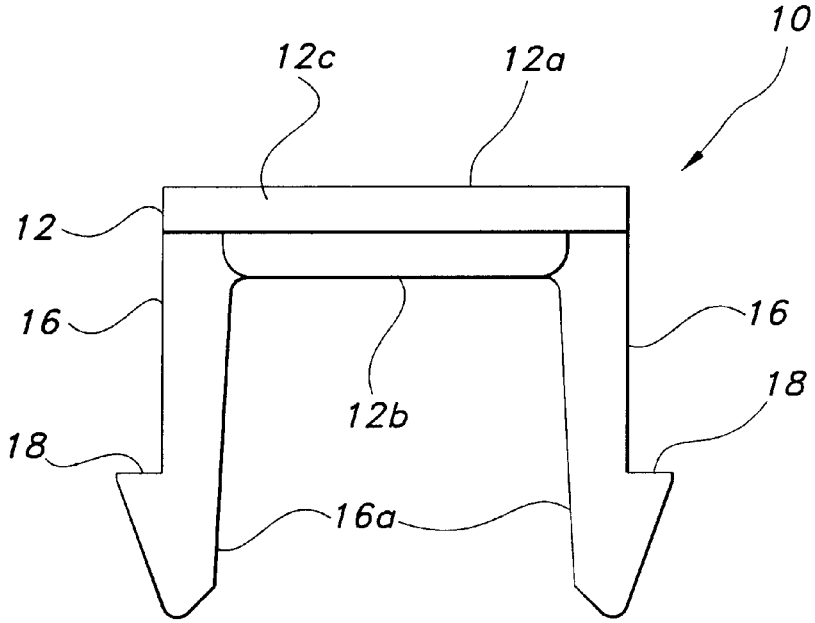
FIG. 2 shows a side view of the ground polarization insert of FIG. 1.

Each of FIGS. 5–10 shows a ground polarization insert of the present invention having a geometric configuration so as to insertably accommodate alternate configurations of a mating ground terminal therein.

DETAILED DESCRIPTION OF THE PREFERRED EMBODIMENTS

The present invention is directed to a ground polarization insert for a power connector or receptacle that is engageable with a self-locking plug. The insert of the present invention is preferably a "snap-in" insert that can be assembled in a receptacle connector at the end of a manufacturing process, thereby enabling the user to ascertain inventory contents and use the insert that corresponds to an end application most anticipated by the user. In this manner, the user can selectively reduce excess inventory according to available components and provide customers with special orders that correspond to already-existing plug and receptacle configurations.

Now referring to the FIGS. 1–4, wherein like elements are identically numbered, a ground polarization insert 10 of the present invention is provided. Insert 10 includes a midsection 12 having a substantially planar top surface 12*a*, a bottom surface 12*b* parallel thereto and a perimetrical wall 12*c* extending therebetween. Wall 12*c* corresponds to a similarly configured recess 30 in a standard power connector 40 (shown in FIG. 3) and further circumscribes a ground terminal orifice 14 for insertable accommodation of a ground terminal therein. Orifice 14 has a preselected configuration that is one of a plurality of configurations (as further shown in FIGS. 5–10) that can matingly accommodate different shapes of plug contacts.

Insert 10 further includes a pair of elongate securement members 16 protruding normally downward from bottom surface 12*b*. Each member 16 is adapted to correspond to correspondingly configured recesses in power connector 40 (not shown). Each member 16 also (includes a securement tab 18 protruding normally from a longitudinal extension 16*a* of the member. The securement members are resiliently deflectable so that tabs 18 may be adapted for frictional engagement with a corresponding recess in power connector 40 (shown in FIG. 3) so as to effect securement of insert 10 therewith.

Figure 3:
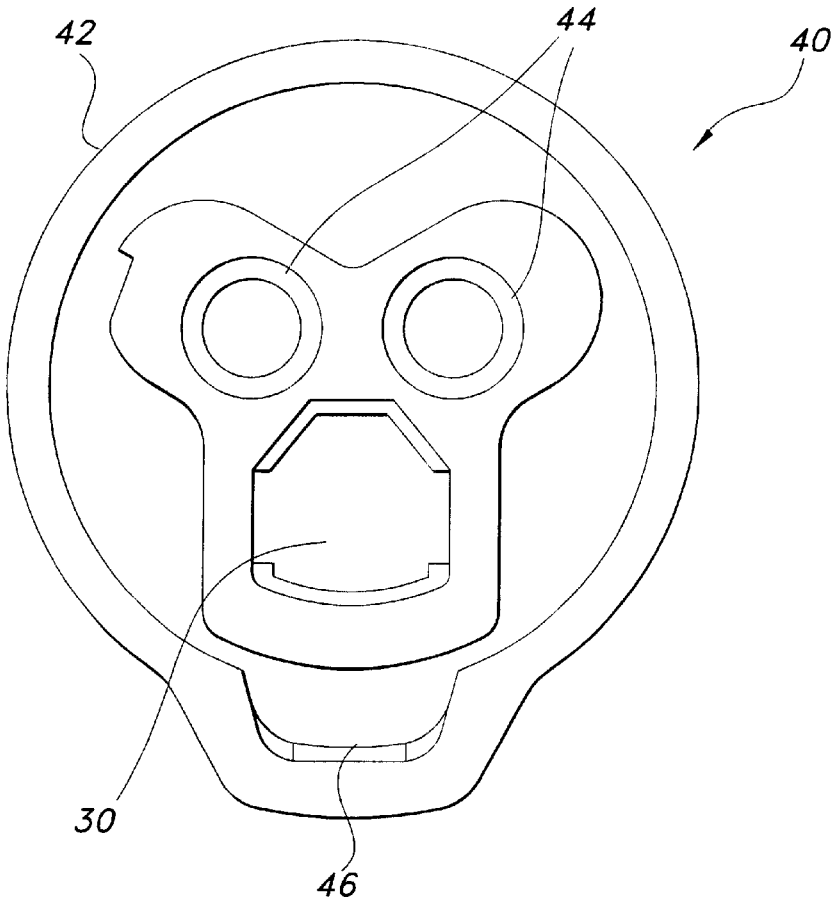
FIG. 3 shows a standard power connector prior to assembly with a ground polarization insert of the present invention.

Insert 10 is particularly adapted for assembly with a standard power connector 40, shown in FIG. 3. Connector 40 includes an outer housing 42 formed from an insulative plastic material. Housing 42 supports a plurality of contact sleeves 44 therein. Sleeves 44 are sized, shaped and oriented to insertably accommodate a corresponding number of plug pins (not shown) therewithin and thereby effect sufficient mechanical and electrical engagement between connector and plug.

Figure 4:
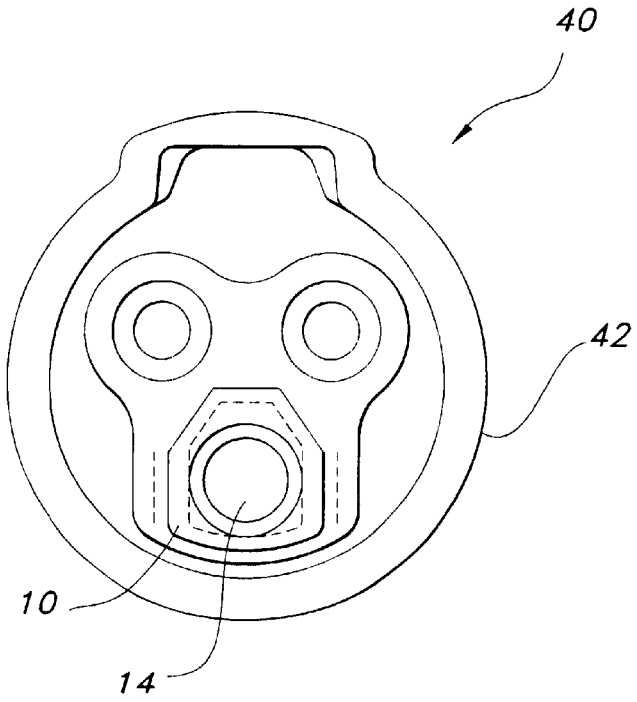
FIG. 4 shows a front view of the power connector of FIG. 3 having a ground polarization insert of FIG. 1 assembled therewith.

Connector 40 is manufactured with a recess 30 defined in accurate spatial relation to sleeves 44 so as to ensure proper engagement of pins within sleeves 44 and orifice 14 of insert 10 after assembly thereof with connector 40. Recess 30 is sized and shaped to accept insert 10 therein, as illustrated in FIG. 4. Although a substantially hexagonal shape is shown for each of insert 10 and recess 30, any configuration conducive to the operation and objects of the present invention may be anticipated by the present disclosure, including but not limited to circular, rectangular, triangular or polygonal designs.

Connector 40 may further include an additional receptacle 46 on a periphery thereof, that accommodates insertion of a spring locking element therein. Such spring element resiliently interlocks with receptacle 46 so as to be retained therein, thereby preventing inadvertent disconnection of connector 40 from a corresponding plug insertably retained therein. Upon the application of pressure to the spring element, the spring element is released from the recess to effect disengagement.

Referring now to FIG. 4, insert 10 is shown after assembly with connector 40. As can be seen, insert 10 resides in close tolerance within the parameters of recess 30 and is secured therewithin by members 16. Insert 10 may be welded or chemically coupled with housing 42 of connector 40 or similar receptacle housing.

The orientation of orifice 14 with respect to sleeves 44 is important in establishing voltage polarization. Insert 10 is assembled in connector 40 and orifice 14 sized and shaped therewithin so as to prevent connection of a grounding terminal with any of sleeves 44. Likewise, the pins corresponding to sleeves 44 will be prevented from insertion in orifice 14. This configuration ensures proper voltage polarization by preventing improper pin-sleeve engagement and damage caused thereby.

Figure 5:
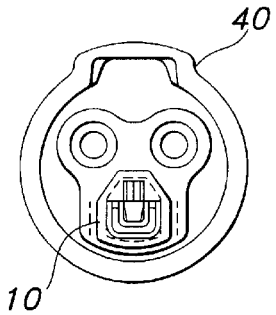
Figure 6:
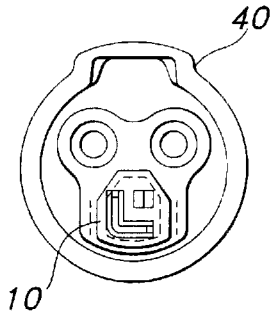
Figure 7:
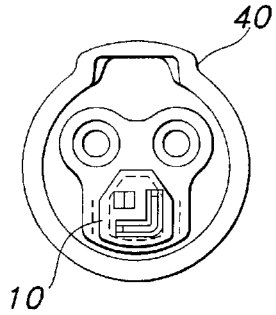
Figure 8:
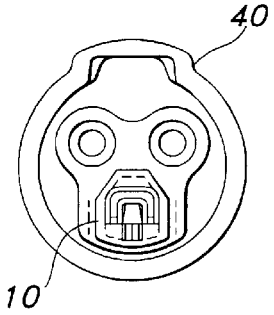
Figure 9:
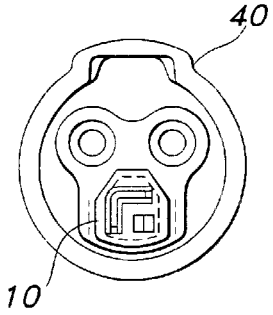
Figure 10:
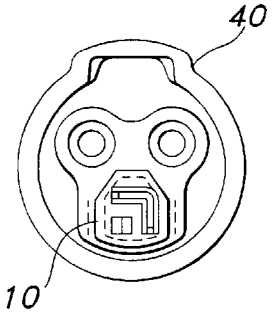

Referring to FIGS. 5–10, alternate geometric configurations of insert 10 are shown. FIG. 5 show insert 10 with an orifice of U-shaped configuration, FIG. 6 shows insert 10 having an orifice of right-handed L-shaped configuration and FIG. 7 shows a similarly configured left-handed L-shaped orifice. FIG. 8 shows an orifice of an inverted U-shape and each of FIGS. 9 and 10 shows an orifice having a rotated L-shaped configuration. It is understood that these embodiments provide mere examples of the types of plugs that can be accommodated by the present invention insert by varying the configuration of the orifice therewithin.

The present invention is reusable through a plurality of cycles at both room and elevated temperatures and prohibits the use of loose parts that may not be interchangeable. The present invention is further amenable to use in many applications requiring a reliable and highly reusable self-locking plug to fit in pre-existing receptacles, such as interconnection with standard receptacle interfaces, portable tools and equipment, battery charging stations, construction quick-disconnect cord sets, portable rough service tools and equipment and lighting and rigging applications. The present invention can be used to apply the connector's locking feature to replacement plugs that conform to an original plug's dimensional envelope without requiring changes thereto. The present invention thereby eliminates the problems of standard connectors while meeting reusability, life cycle, cost and weight goals.

Various changes and modifications can be made to the present invention as would now be evident to those skilled in the art. Accordingly, it is intended that all such changes and modifications come within the scope of the invention as set forth in the following claims.

What is claimed is:

1. A kit of parts comprising:

a connector having an electrical contact supported within a housing in a contact accommodating recess;

a plurality of inserts, each being adapted for attachment to said connector, each said insert having a surface adapted for overlying said recess and further having one of a plurality of differently configured plug accepting orifices therethrough;

wherein each said insert uniquely permits insertion of only a plug of mating configuration and further includes a midsection having a substantially planar top surface, a bottom surface parallel thereto and a perimetrical wall extending therebetween wherein said perimetrical wall circumscribes said plug accepting orifice.

2. The kit of claim 1 wherein a pair of elongate members protrude downwardly in normal relation to said bottom surface, each of said members having a shoulder at an extremity thereof that protrudes perpendicularly from a longitudinal direction of said member.

3. The kit of claim 2 wherein each said elongate member includes a securement tab protruding normally from a longitudinal extension thereof for frictional engagement with said accommodating recess.

4. The kit of claim 1 wherein said insert is welded or chemically coupled with said housing.

* * * * *